United States Patent [19]

Miyamoto et al.

[11] 4,442,953

[45] Apr. 17, 1984

[54] APPARATUS FOR SUPPLYING FLUID OF PRESET QUANTITY

[75] Inventors: Yoshikazu Miyamoto, Kokubunji; Tetsuya Kakimoto, Tatomi; Wasaburo Tanida, Tokyo, all of Japan

[73] Assignee: Tokico Ltd., Kawasaki, Japan

[21] Appl. No.: 298,878

[22] Filed: Sep. 2, 1981

[30] Foreign Application Priority Data

Sep. 5, 1980 [JP] Japan ..... 55-123350

[51] Int. Cl.[3] ..... B67D 5/08

[52] U.S. Cl. ..... 222/14; 222/26; 364/479; 377/21

[58] Field of Search ..... 222/14, 20, 22, 23, 222/25, 2, 15–19, 21, 26–28, 36, 37; 194/3, 13; 364/479; 377/21, 28, 30

[56] References Cited

U.S. PATENT DOCUMENTS 3,601,284 8/1971 Yamawaki ..... 222/2

4,354,620 10/1982 Tsuneda et al. ..... 222/25 X

*Primary Examiner*—Joseph J. Rolla

*Attorney, Agent, or Firm*—Andrus, Sceales, Starke & Sawall

[57] ABSTRACT

An apparatus for supplying fluid of preset quantity comprises a fluid supplying pump provided in a fluid supplying pipe arrangement, a motor for driving the fluid supplying pump, meter for metering the fluid flowing in the fluid supplying pipe arrangement, and a control circuit for detecting that supplied quantity of fluid measured by the meter has reached a quantity smaller than a preset fluid supplying quantity by an estimated oversupply quantity of fluid, and stopping the motor from being driven. The estimated oversupply quantity of fluid is set to a quantity equal to a quantity of fluid supplied by the fluid supplying pump after the motor is stopped from being driven and rotates due to inertia.

6 Claims, 3 Drawing Figures

APPARATUS FOR SUPPLYING FLUID OF PRESET QUANTITY

BACKGROUND OF THE INVENTION

The present invention generally relates to apparatuses for supplying fluid of preset quantity, and more particularly to an apparatus capable of accurately supplying fluid of preset quantity without introducing oversupply of fluid.

Conventionally, in most general apparatuses for supplying fluid of predetermined quantity, an accumulated flow quantity value measured by a flowmeter is supplied to a preset counter, and the preset counter generates a control signal when the accumulated flow quantity value coincides with a preset value of the preset counter, to close a valve by the control signal. However, the quantity of fluid which flows from the time the valve begins to close and the time the valve actually closes completely, should not be supplied. This quantity of fluid which actually should not be supplied, is the so-called oversupply quantity.

Accordingly, there are apparatuses which use a two-step valve closing system in closing the valve, in order to reduce the above oversupply quantity of fluid. In these apparatuses, the valve which is in a fully open state is closed by a certain amount when the supplied quantity of fluid reaches a value close to a predetermined quantity to continue the supply of fluid with a small flow quantity, and the partly closed valve is closed completely when the supplied quantity of fluid reaches the predetermined quantity, so as to improve the accuracy of the apparatus. However, a valve driving device having a complex construction is required to close the valve in two steps as described above. Therefore, the construction of the fluid supplying apparatus as a whole became complex. Moreover, even when the valve is closed in the above two steps, the oversupply quantity of fluid cannot be completely eliminated, and there was a limit in improving the accuracy of the fluid supplying apparatus.

SUMMARY OF THE INVENTION

Accordingly, it is a general object of the present invention to provide a novel and useful apparatus for supplying fluid of preset quantity, in which the above described disadvantages have been overcome.

Another and more specific object of the present invention is to provide an apparatus for supplying fluid of preset quantity, capable of supplying fluid of preset quantity with extremely high accuracy, by stopping the driving operation to drive a fluid supplying pump at a point in time when the supplied quantity of fluid is less than a preset fluid supplying quantity by an estimated oversupply quantity of fluid which is estimated before the supplied quantity of fluid reaches the preset quantity. According to the apparatus of the present invention, a valve driving device having a complex construction is not required as in a conventional apparatus for supplying fluid of predetermined quantity in which the valve is closed by use of a control signal.

Still another object of the present invention is to provide an apparatus for supplying fluid of preset quantity which measures the flow quantity of the supplied fluid at a point in time before the supplied quantity of fluid reaches a preset fluid supplying quantity, and estimates the oversupply quantity of fluid for that particular flow quantity from value known from experience, to stop the above driving operation to drive the fluid supplying pump according to the estimated oversupply quantity of fluid. According to the apparatus of the present invention, the estimated value for the oversupply quantity of fluid is accurate unless there is a large variation in the flow quantity of ejected fluid from the pump. Moreover, an operation can be performed to supply fluid of predetermined quantity with extremely high accuracy, since the apparatus is constructed to control the stoppage of the fuel supply according to the accurate oversupply quantity of fluid obtained.

Other objects and further features of the present invention will be apparent from the following detailed description when read in conjunction with the accompanying drawings.

DETAILED DESCRIPTION

Figure 1:
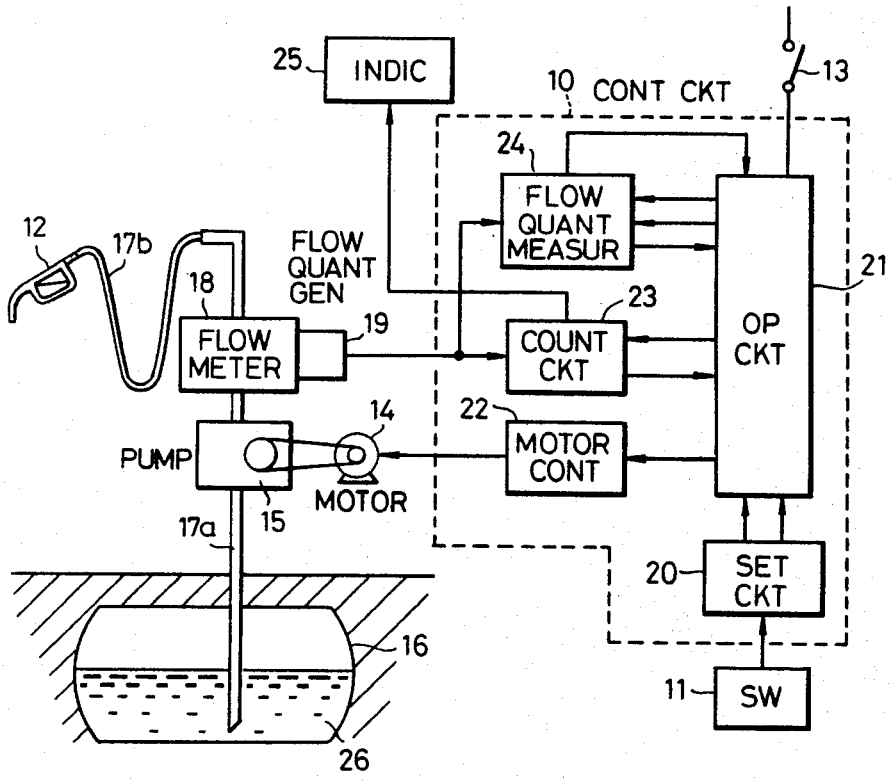
FIG. 1 is a substantial systematic block diagram showing an embodiment of an apparatus for supplying fluid of preset quantity according to the present invention.

In FIG. 1, before starting a fluid supplying operation, a key switch 11 is operated to preset a desired fluid supplying quantity $Q_s$ within a control circuit 10. The above preset fluid supplying quantity $Q_s$ is preset in a setting circuit 20 within the control circuit 10, as will be described hereinafter.

When a fluid supplying nozzle 12 is unhooked from a nozzle hook (not shown) of a known construction upon supplying of fluid, a switch 13 provided on the nozzle hook is closed. Hence, a signal is obtained from an operation circuit 21 within the control circuit 10, and this signal is applied to a pump driving motor 14 through a motor control circuit 22 to drive the pump driving motor 14. A fluid supplying pump 15 is driven due to the rotation of the motor 14, to suck a fluid 26 stored in a tank 16 through a pipe arrangement 17*a*. Thus, when a valve of the fluid supplying nozzle 12 is opened, the fluid 26 which is sucked up from the tank 16 flows through a flowmeter 18, a hose 17*b*, and the nozzle, to be supplied to a tank (not shown) of a vehicle.

Upon supply of the fluid, the supplied quantity of fluid is measured at the flowmeter 18. This measured supplied quantity of fluid is supplied as a pulse signal to a counting circuit 23 and a flow quantity (flow current) measuring circuit 24 within the control circuit 10, from a flow quantity generator 19. A flow current measuring circuit can be used instead of the above flow quantity measuring circuit 24, however, in the present embodiment of the invention, the circuit 24 will be described as the flow quantity measuring circuit. The counting circuit 23 is applied with a reset signal from the operation circuit 21 when the switch 13 is in a closed state, and is reset to zero. However, when the fluid supplying operation is started, the counting circuit 23 starts to count the pulses from the flow quantity generator 19 from zero in an accumulative manner. The accumulated value which is counted in the counting circuit 23 is applied to an indicator 25 which is provided at a position easily visible from the fluid supplying position, and a display of the supplied fluid quantity is accordingly obtained.

Figure 2:
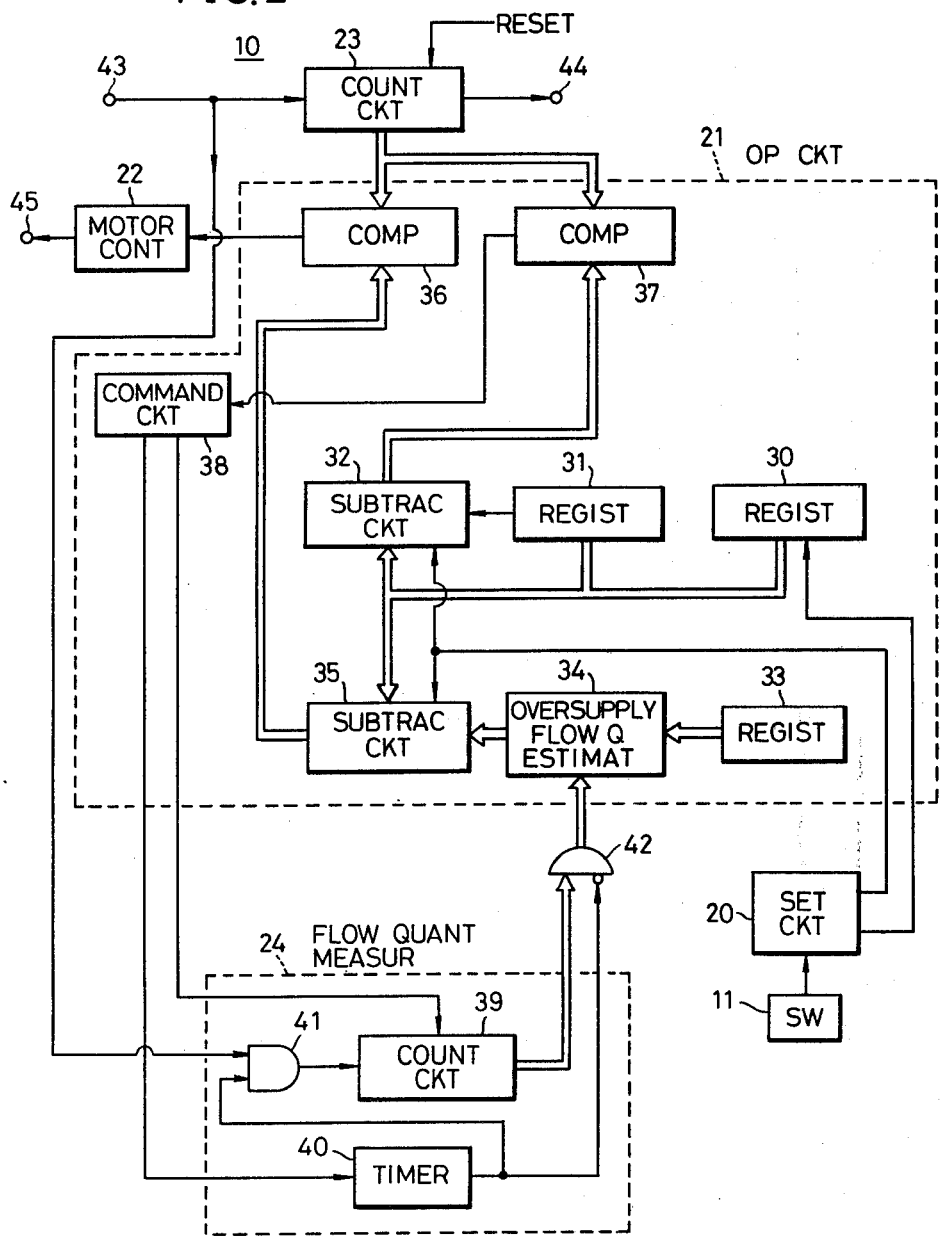
FIG. 2 is a detailed systematic block diagram showing an embodiment of a control circuit which constitutes an essential part of the apparatus shown in FIG. 1.

The above control circuit 10, especially the operation circuit 21 has a circuit construction shown in FIG. 2, for example. Actually, the control circuit 10 is constructed from a micro-computer, for example, and the operation circuit 21, for example, is shown as a block system in order to simplify the description of the operation. Accordingly, it is not essential for the apparatus of the present invention to have the circuit system shown in FIG. 2.

In FIG. 2, when the key of the key switch 11 is operated before starting of the fluid supply to preset a desired fluid supplying quantity, the desired fluid supplying quantity is set in the setting circuit 20. In the operation circuit 21, a register 30 stores therein the preset fuel supplying quantity $Q_s$ obtained from the setting circuit 20. A predetermined value $\overline{Q}_p$ ($\overline{Q}_p = Q_s - Q_p$) for specifying a supplied fluid quantity $Q_p$ at a point in time when an oversupply quantity of fluid $\Delta Q$ is estimated, is stored in advance within a register 31. Moreover, a coefficient $\underline{K}$ required for estimating the above oversupply quantity of fluid $\Delta Q$, is stored in advance within a register 33.

A unit fluid supplying quantity signal pulse $\underline{P}$ generated from the flow quantity generator 19 is supplied to the counting circuit 23 through a terminal 43, and also supplied to the flow quantity measuring circuit 24. The flow quantity measuring circuit 24 measures a flow quantity $\underline{q}$ of the fluid being supplied, at a point in time when a fluid supplying quantity $\underline{Q}$ ($Q = \Sigma P$) reaches a value smaller than the preset fluid supplying quantity $Q_s$ by the predetermined value $\overline{Q}_p$. In addition, in a case where the flow quantity measuring circuit 24 is a flow current measuring circuit, the flow current is measured at the above point in time.

That is, a subtracting operation is performed in a subtraction circuit 32 within the operation circuit 21 to perform an operation $Q_p = Q_s - \overline{Q}_p$ between the values $Q_s$ and $\overline{Q}_p$ respectively stored within the registers 30 and 31, in order to obtain the supplied fluid quantity $Q_p$ which determines the operating point of the flow quantity measuring circuit 24. The above supplied fluid quantity $Q_p$ is applied to a comparator 37. On the other hand, the fluid supplying quantity $\underline{Q}$ obtained as a result of the counting operation performed by the counting circuit 23, is supplied to the indicator 25 through a terminal 44, and is also applied to comparators 36 and 37. When the supplied fluid quantity $\underline{Q}$ from the counting circuit 23 coincides with the quantity $Q_p$ from the subtraction circuit 32 at the comparator 37, that is, when it is detected that $Q = Q_p$, a command circuit 38 is operated by an output of the comparator 37. A counting circuit 39 and a timer circuit 40 within the flow quantity measuring circuit 24 are operated by a command from the above command circuit 38.

The above timer circuit 40 is constructed to produce a signal for a predetermined time interval when the timer circuit 40 receives the command from the command circuit 38. An output of the timer circuit 40 is supplied to gate circuits 41 and 42. The gate circuit 41 opens the gate for a duration in which the output of the timer circuit 40 is applied thereto, and supplies a pulse indicating the flow quantity $\underline{q}$ from the flow quantity generator 19, to the counting circuit 39. Accordingly, the counting circuit 39 counts the flow quantity pulse supplied thereto during the interval in which the gate circuit 41 opens the gate, and the flow quantity $\underline{q}$ at that point in time is measured.

The flow quantity $\underline{q}$ measured at the flow quantity measuring circuit 24 is supplied to an oversupply flow quantity estimating circuit 34 within the operation circuit 21 by the counting circuit 39, through the gate circuit 42 which is open when the output of the timer circuit 40 disappears. The above estimating circuit 34 multiplies the coefficient $\underline{K}$ obtained from the register 33 with the flow quantity $\underline{q}$ obtained from the flow quantity measuring circuit 24, that is, performs an operation $\Delta Q = K \times q$. The estimating circuit 34 is provided for estimating the oversupply quantity of fluid $\Delta Q$ ejected from the pump 15 until the pump 15 stops completely, in a case where the pump 15 is stopped when the pump ejecting flow quantity is $\underline{q}$.

Figure 3:
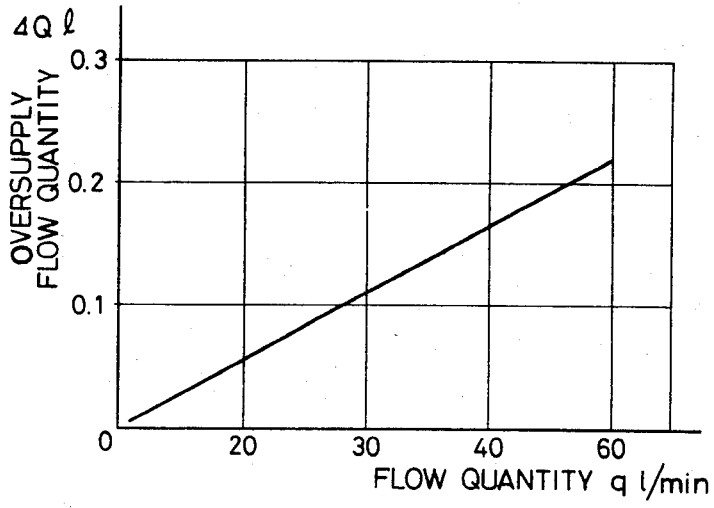
FIG. 3 is a graph showing the relationship between the pump ejecting flow quantity and the oversupply quantity of supplied fluid.

The above coefficient $\underline{K}$ which is to be multiplied with the flow quantity $\underline{q}$ stored within the register 33, is of a value known from experience obtained as follows, for example. In obtaining the above coefficient $\underline{K}$, data obtained by experimentally supplying fluid is used, for example, as shown in FIG. 3. In FIG. 3, the horizontal axis indicates the ejecting flow quantity $\underline{q}$ of the pump 15, and the vertical axis indicate the oversupply quantity of fluid $\Delta Q$ at each flow quantity. As is clearly seen from FIG. 3, a relationship $\Delta Q = K \cdot q$ stands between the oversupply quantity of fluid $\Delta Q$ and the pump ejecting flow quantity $\underline{q}$.

The oversupply quantity of fluid $\Delta Q$ thus obtained at the estimating circuit 34 is supplied to a subtraction circuit 35. The subtraction circuit 35 performs a subtracting operation between the preset fluid supplying quantity $Q_s$ from the register 30 and the oversupply quantity of fluid $\Delta Q$ from the estimating circuit 34, that is, performs an operation $Q_{sa} = Q_s - \Delta Q$. Accordingly, the apparent preset fluid supplying quantity $Q_{sa}$ is obtained. In the apparatus according to the present invention, the operation of the motor 14 is stopped when the supplied fluid quantity $\underline{Q}$ reaches the apparent fluid supplying quantity $Q_{sa}$, which is less than the preset fluid supplying quantity $Q_s$ by the estimated oversupply quantity of fluid $\Delta Q$.

That is, the apparent preset fluid supplying quantity $Q_{sa}$ is supplied to the comparator 36. When the value of the above apparent preset fluid supplying quantity $Q_{sa}$ coincides with that of the supplied fluid quantity $\underline{Q}$ from the counting circuit 23 at the comparator 36, that is, when it is detected that $Q = Q_{sa}$, the comparator 36 produces a motor stopping signal. This motor stopping signal is supplied to the motor control circuit 22. Accordingly, the motor 14 is disconnected from the power source by the motor control circuit 22.

However, the motor 14 continues to rotate due to inertia, even after the motor 14 is disconnected from the power source. Hence, the pump 15 continues to supply fluid even after the motor 14 is disconnected from the power source, until the rotation of the motor 14 due to inertia is completely stopped. The quantity of fluid supplied during the interval from the time when the motor 14 is disconnected from the power supply to the time when the rotation of the motor 14 stops completely, is equal to the above estimated oversupply quantity of fluid $\Delta Q$. Accordingly, although the motor 14 is disconnected from the power source when the supplied fluid quantity $\underline{Q}$ reaches the apparent preset fluid supplying quantity $Q_{sa}$, when the rotation of the motor 14 due to inertia stops completely, the total quantity of supplied fluid accurately coincides with the preset fluid supplying quantity $Q_s$.

In the apparatus for supplying fluid of preset quantity having the above described construction, at a point in time before the supplied fluid quantity $\underline{Q}$ reaches the preset fluid supplying quantity $Q_s$, the oversupply quantity of fluid $\Delta Q$ assumed for the flow quantity (or flow current) $\underline{q}$ at that particular point in time is estimated. Moreover, the driving operation for the pump 15 is stopped when the supplied quantity of fluid $\underline{Q}$ reaches a value smaller than the preset fluid supplying quantity $Q_s$ by the oversupply quantity of fluid $\Delta Q$. Therefore, a special valve for supplying fluid of predetermined quantity is not required as in the conventional apparatus for supplying fluid of predetermined quantity, for example, and the supply of fluid of predetermined quantity can be performed accurately by only controlling the timing at which the pump 15 is stopped.

In the above described embodiment of the invention, the coefficient $\underline{K}$ which is set in the register 33 is uniquely determined when the relationship between the pump ejecting flow quantity $\underline{q}$ and the oversupply fluid quantity $\Delta Q$ is linear in FIG. 3. However, when the above relationship is non-linear, the coefficient $\underline{K}$ can be calculated by performing linear approximation in the vicinity of the flow quantity $\underline{q}$ which is used, or by reading out the corresponding coefficient $\underline{K}$ stored in advance according to the value of the flow quantity $\underline{q}$. Actually, when an error in the range of $\pm\Delta q$ ($\approx 0.1q$) exists in the flow quantity $\underline{q}$ obtained at the point in time when the oversupply quantity of fluid $\Delta Q$ is estimated, or when the flow quantity $\underline{q}$ at the point in time when the motor 14 is stopped differ in the range of $\pm\Delta q$ ($\approx 0.1q$) with respect to the flow quantity $\underline{q}$ obtained at the point in time when the oversupply quantity of fluid $\Delta Q$ is estimated, these errors $\Delta q$ do not effect the accuracy of the fluid supplying operation. Accordingly, by suitably limiting the range of linear approximation, the error introduced by the above linear approximation can be suppressed so as not to effect the accuracy of the fluid supplying operation.

Furthermore, in the present embodiment of the invention, the preset fluid supplying quantity $Q_s$ is preset before the fluid supplying operation is performed. However, the preset fluid supplying quantity $Q_s$ can be preset after starting of the fluid supplying operation or by using a signal received from another system, and the time when the quantity $Q_s$ is preset can be selected arbitrarily. In a fuel supplying apparatus using a known automatic stopping nozzle, for example, when the supplied quantity of fluid is an odd value such as 20.1 liters, for example, after the supply of fluid is stopped automatically by detecting the fluid surface within the tank, there are known fluid supplying apparatuses which automatically stop the fluid supplying operation after the supplied quantity of fluid reaches 21.0 liters when the nozzle 12 is automatically or manually operated afterwards to open the valve. In this type of a fluid supplying apparatus, detection can be performed mechanically to detect that the valve of the nozzle 12 has closed or it can be detected that the flow of the fluid has decreased or stopped by use of a pulse signal obtained from a pulse generator, and the flow quantity or flow current can be measured by use of an output obtained as a result of the above detection or by detecting the above output and the starting of the re-supply of fluid, to operate the measuring circuit 24. In this case, one liter, for example, can be added to an odd quantity of supplied fluid at an operation circuit which corresponds to the fluid supplying quantity setting circuit 20, and a value obtained by truncating beyond the decimal point can be supplied to the subtraction circuit 35.

Further, this invention is not limited to these embodiments but various variations and modifications may be made without departing from the scope of the invention.

What is claimed is:

1. An apparatus for supplying fluid of preset quantity comprising:

a fluid supplying pump provided in a fluid supplying pipe arrangement;

a motor for driving said fluid supplying pump;

metering means for metering the fluid flowing in said fluid supplying pipe arrangement;

presetting means for presetting a quantity of fluid to be supplied; and control means coupled to said motor, said metering means, and said presetting means, for detecting that supplied quantity of fluid measured by said metering means has reached a quantity smaller than the preset fluid supplying quantity preset by said presetting means by an estimated oversupply quantity of fluid, and stopping said motor from being driven, said estimated oversupply quantity of fluid being a quantity equal to a quantity of fluid supplied by said fluid supplying pump after said motor is stopped from being driven and rotates due to inertia, said control means including a first register prestored with a coefficient, and estimating means for estimating said estimated oversupply quantity of fluid from said coefficient stored in said first register.

2. An apparatus as claimed in claim 1 in which said metering means has a flowmeter provided in said fluid supplying pipe arrangement, and a metering circuit for accumulating the flow quantity measured by said flowmeter and metering the supplied quantity of fluid, and said control means includes measuring means for measuring the flow quantity or the flow current from said flowmeter when the supplied quantity of fluid from said metering circuit reaches a quantity smaller than the preset fluid supplying quantity by a predetermined quantity, and stopping means for stopping said motor from being driven when the supplied quantity of fluid from said metering circuit reaches the quantity smaller than said preset fluid supplying quantity by said estimated oversupply quantity of fluid obtained from said estimating means, said estimating means carrying out a mathematical operation to obtain said estimated oversupply quantity of fluid by use of said coefficient stored in said first register and a measured result obtained by said measuring means.

3. An apparatus as claimed in claim 1 in which said metering means has a flowmeter provided in said fluid supplying pipe arrangement, and a metering circuit for accumulating the flow quantity measured by said flowmeter and metering the supplied quantity of fluid, and said control means further includes:

a second register for storing a preset fluid supplying quantity preset by said presetting means;

a third register for storing a predetermined quantity which has been preset;

a first subtraction circuit for subtracting the predetermined quantity obtained from said third register from the preset fluid supplying quantity obtained from said second register;

a first comparator for detecting that the value of the supplied quantity of fluid obtained from said metering circuit and a value obtained from said first subtraction circuit coincide;

measuring means responsive to an output of said first comparator, for measuring the flow quantity or the flow current from said flowmeter;

said estimating means multiplying the coefficient obtained from said first register to a measured result obtained from said measuring means;

a second subtraction circuit for subtracting a value obtained from said estimating means from the preset fluid supplying quantity obtained from said second register;

a second comparator for detecting that the supplied quantity of fluid obtained from said metering circuit and a value from said second subtraction circuit coincide; and a control circuit responsive to an output of said second comparator, for stopping said motor from being driven.

4. An apparatus as claimed in claim 3 in which said measuring means has a counter for measuring the flow quantity or the flow current from said flowmeter, and a timer responsive to the output of said first comparator, for substantially operating said counter for a predetermined time interval.

5. An apparatus as claimed in claim 3 in which said coefficient stored in said first register with respect to a kind of fluid is obtained from a linear or a linear approximation of the relationship between the pump ejecting flow quantity and the oversupply quantity of fluid.

6. An apparatus as claimed in claim 5 in which said coefficient is variable according to the kind of fluid.

* * * * *